US005360999A

United States Patent [19]

Upshaw et al.

[11] Patent Number: 5,360,999

[45] Date of Patent: Nov. 1, 1994

[54] EXPLOSIVELY ACTUATED THERMAL OPENING SWITCH

[75] Inventors: Jim L. Upshaw; Jonathan J. Hahne; Richard J. Hayes; Raymond C. Zowarka, Jr.; John P. Kajs; Robert L. Sledge, II, all of Austin, Tex.

[73] Assignee: Board of Regents, The University of Texas System, Austin, Tex.

[21] Appl. No.: 23,808

[22] Filed: Feb. 25, 1993

[51] Int. Cl.[5] ..... H01H 39/00

[52] U.S. Cl. ..... 307/112; 89/8; 124/3; 200/61.08; 337/4; 361/103

[58] Field of Search ..... 200/61.08, 82 R; 89/8; 102/216; 361/103; 337/4, 6, 7, 30, 158, 243, 298, 299, 401; 307/112-157; 124/3; H01H 39/60

[56] References Cited

U.S. PATENT DOCUMENTS

| | | | |
|---|---|---|---|
| 3,851,219 | 11/1974 | Kozorezov et al. | 361/103 |
| 4,174,471 | 11/1979 | Ford et al. | 200/61.08 |
| 4,176,385 | 11/1979 | Dethlefsen | 361/58 |
| 4,311,890 | 1/1982 | Schroder | 200/61.08 |
| 4,538,133 | 8/1985 | Pflanz | 337/4 |
| 4,571,468 | 2/1986 | Weldon | 200/61.08 |
| 4,621,561 | 11/1986 | Weldon | 89/8 |
| 4,680,434 | 7/1987 | Skogmo et al. | 200/61.08 |
| 4,859,819 | 8/1989 | Weldon et al. | 200/146 R |
| 5,070,787 | 12/1991 | Weldon et al. | 102/216 |

FOREIGN PATENT DOCUMENTS 660027 3/1963 Canada .

OTHER PUBLICATIONS

"Research Roundup," Instrum. Technol. (USA), vol. 24, No. 12, pp. 27-28 (Dec. 1977).

*Primary Examiner*—J. R. Scott

*Attorney, Agent, or Firm*—Arnold, White & Durkee

[57] ABSTRACT

An apparatus and method are provided for controlling the switching characteristics of an explosively actuated switch. The switch comprises a conductor that is only partially severed by explosive forces. A bridge region, the conductive portion of the conductor remaining after the explosion, is then severed by thermal breakdown. Variations in the bridge region enable a user to vary the switching characteristics of the switch.

17 Claims, 5 Drawing Sheets

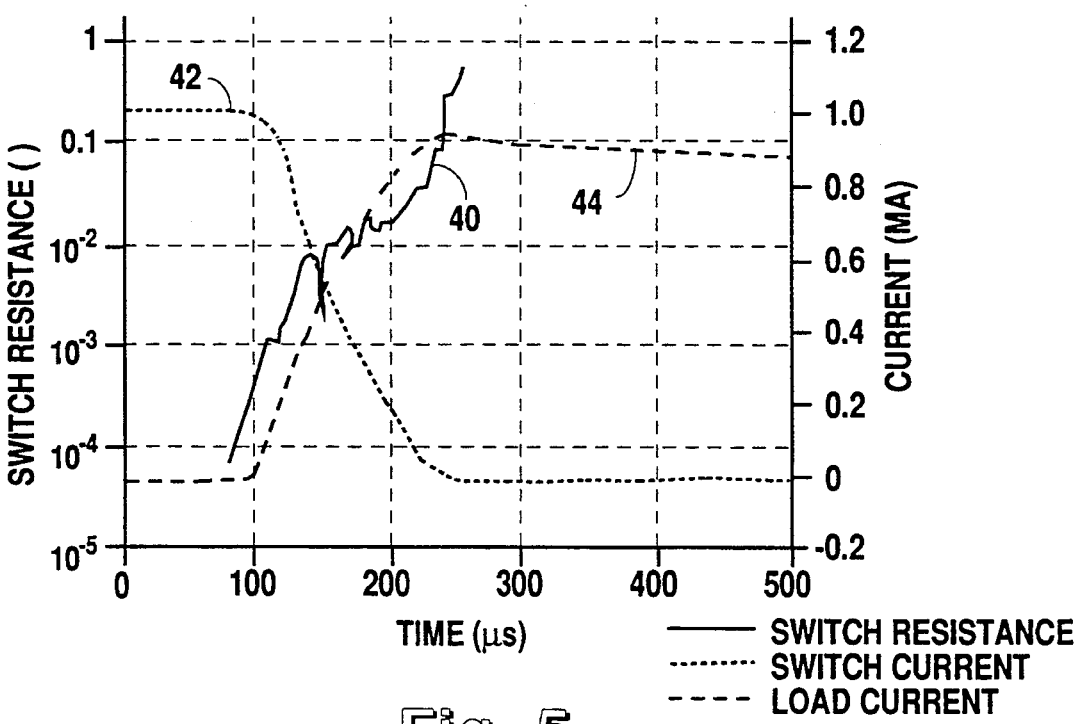
Fig. 5
( PRIOR ART )
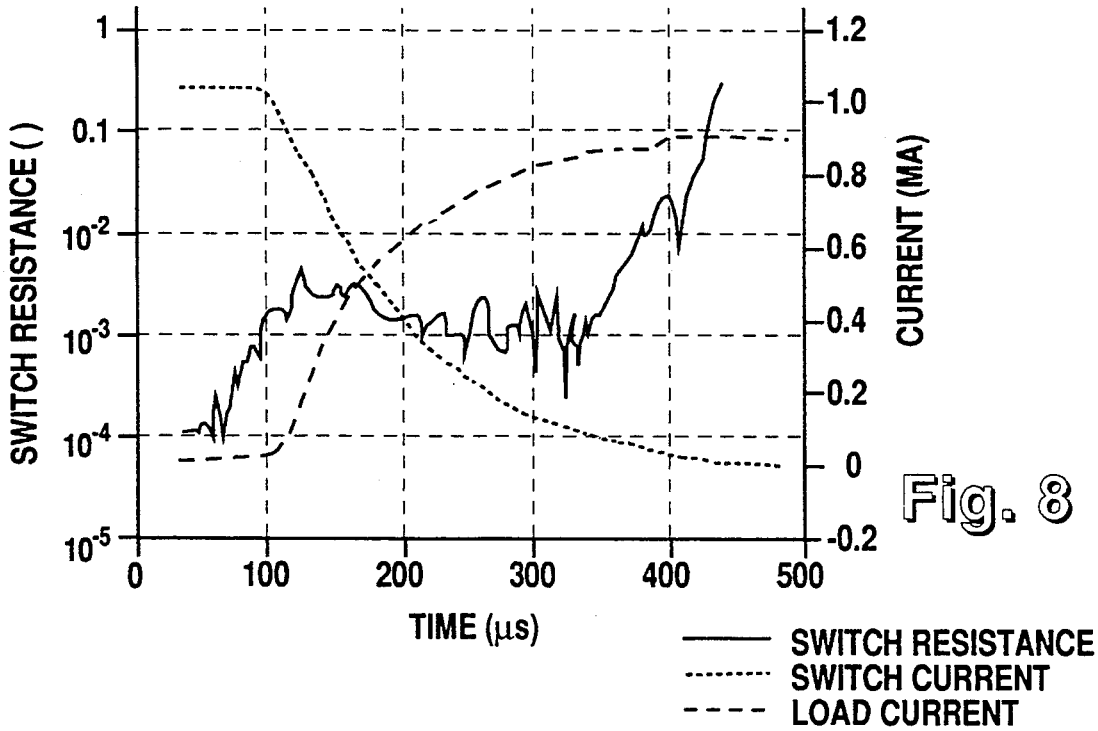
Fig. 8
Fig. 8

EXPLOSIVELY ACTUATED THERMAL OPENING SWITCH

This invention was made with Government support and the Government has certain rights in the invention.

BACKGROUND OF THE INVENTION

The present invention relates to switches for switching high electrical currents into electrical loads. More particularly, the present invention relates to explosively actuated switches.

Many types of explosively actuated switches have been proposed for various applications. Explosively actuated switches typically perform their switching functions very quickly. Such switches are thus utilized in applications where switching must be accomplished rapidly. A particular application of explosive switches is where a switch must carry extremely high currents and yet still switch quickly. For example, explosive switches may be utilized with large inductive energy storage systems, such as may be utilized to power electromagnetic railguns. In such applications, the switch is initially closed to provide high current charging of an inductor over an extended period of time, and then is exploded open to commute the current to the load within a relatively short time interval. High power explosive switches also have utility in other applications, such as, for example, actuating laser flashlamps and as circuit interrupts in the electric utility industry.

Inductive energy storage systems typically include a primary energy source, such as a homopolar generator, an inductor, and a primary opening switch element. Heretofore, inductive energy storage systems have been utilized as high voltage pulse generators and, more recently as the power source in railgun accelerators. The accelerating force in a railgun is obtained by the interaction of the current in a driven armature with the magnetic field produced by the current in the rails, with the armature and the rails being connected in series. The rate at which an opening switch delivers current into the load will effect the mechanical jerk seen by a projectile and its driving armature and will also effect the acceleration ratio of the gun. Furthermore, the current waveform seen by the railgun affects the stability of the armatures.

Prior art explosive switches suitable for carrying high current loads have typically utilized solid conductive plates. These prior art switches completely sever the conductive plate with explosive charges, thus, interrupting the circuit. In addition, the explosive gas flows over the metal vapor arc and raises the dielectric constant of the gas-metal vapor mixture as well as cooling the arc. Usually the switching waveforms associated with explosive switches produce current rise times of 125 microseconds or less. Although this produces desirable acceleration rates within a railgun, the resulting stresses on a projectile may be too high. Further, conventional explosive switch systems generally control the switching characteristics by increasing the inductance of the load, which results in a subsequent loss of efficiency. Therefore, it is desirable to produce more controlled switching characteristics from an explosive switch and to produce a slower current rise without adjusting the load parameters.

U.S. Pat. No. 4,571,468 to Weldon discloses a fast acting explosive switch. Weldon recognizes that a relatively slow controllable switching characteristic may be desirable. As typical in most explosive switches though, in Weldon the explosive force is applied such that it completely extends across the conductor. Thus, there is no suggestion in Weldon that the conductor may be only partially severed by the explosive forces. The switching characteristics contemplated in Weldon are, therefore, a function of the explosive pressure rise time and the resulting gap that is contemplated to extend completely across a conductor. Weldon addresses switching times of at least one millisecond. It is desirable to make switches slower than conventional explosive switches yet faster than Weldon. Weldon does not contemplate a region designed to thermally break down. It is desirable to be able to more accurately control the switching characteristics, in particular a load current rise time, than is available solely from adjusting pressure forces and the gap width geometries as in Weldon.

U.S. Pat. No. 4,538,133 to Pflanz discloses an auxiliary fuse placed in series with a parallel combination of an explosive fuse and a main fuse. When this switch system is exposed to a high current fault above a predetermined level, the auxiliary fuse melts and the resulting voltage increase across the auxiliary fuse is used to detonate the explosive fuse. When the explosive fuse is blown, current flows through the main fuse which then melts to provide the final current interruption. U.S. Pat. No. 4,479,105 to Banes discloses a switch similar to Pflanz that incorporates an explosive fuse in parallel with a nonexplosive fuse.

Both of these patents disclose complicated switches that require at least two separate fuses placed in parallel and a connection means to connect these fuses. For example, Pflanz uses additional connecting straps **42*a* and 42*b*** and associated bolts to connect a nonexplosive fuse to the explosive fuse. A simplified one conductor switch is desirable so that reliability and space requirements may be improved and additional connection problems and costs may be eliminated. Furthermore as noted in Banes, the function of such nonexplosive parallel fuses is to divert current from the main fuse in order to extinguish arcs. Also, these switches concentrate on quickly interrupting current rather than quickly interrupting current in a controlled manner to obtain a specific current characteristic and waveform.

It has now been discovered that slowing the switching current and controlling the switching waveform from an explosive switch produces desirable results in an inductive energy storage system. Therefore, it is desirable to have an explosive fuse that has controlled switching characteristics. Furthermore, the switching characteristics should enable current to be switched within hundreds of microseconds. In addition, it is desirable that such an explosive switch be incorporated into a simple one conductor system.

SUMMARY OF THE INVENTION

The device and methods of the present invention are directed at the problems outlined above. More particularly, the apparatus and methods of the present invention cause a large current to be switched quickly yet under controlled conditions. Furthermore, the switch is made of a simple unitary structure. In a general aspect, the present invention comprises a switch or fuse which operates in stages to reduce or interrupt the flow of electrical current. The switch includes an explosive placed proximate an electrical conductor so that a portion of the conductor remains after the explosive force has been applied to the conductor, thereby leaving a residual conductive path of reduced cross section through the conductor. In one embodiment a plurality of substantially parallel channels are formed in the conductor and adapted to house the explosive. A bridge region within the conductor is adapted to conduct current after the explosive has been detonated. Furthermore, the bridge region may contain a break down area in which a groove is formed. The present invention also comprises a method of interrupting current in which current is directed through a unitary electrical conductor, then a portion of the electrical conductor is explosively severed and a second portion of the conductor thermally breaks down.

BRIEF DESCRIPTION OF THE DRAWINGS

So that the manner in which the herein described advantages and features of the present invention, as well as others which will become apparent, are obtained and can be understood in detail, more particular description of the invention summarized above may be had by reference to the embodiment thereof which is illustrated in the appended drawings, which drawings form a part of this specification.

FIG. 5 is a graph of the switching characteristics of a prior art explosively actuated switch.

FIG. 8 is a graph of the switching characteristics of a explosively actuated switch according to the present invention.

It is to be noted, however, that the appended drawings illustrate only exemplary embodiments of the invention and are therefore not to be considered limiting of its scope, for the invention may admit to other equally effective embodiments.

DETAILED DESCRIPTION

Figure 1:
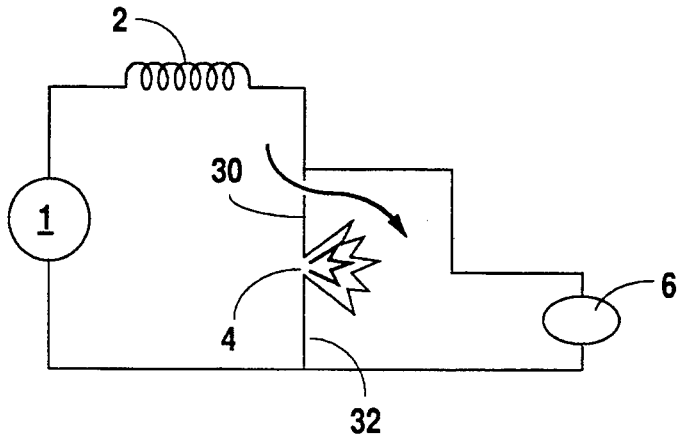
FIG. 1 is a schematic of an inductive energy storage system.

An inductive energy storage system is shown schematically as an electrical circuit in FIG. 1. Primary energy source 1, such as a homopolar generator, inductor 2, and explosive switch 4 are connected to load 6, for example an electromagnetic railgun. Conductive leads 30 and 32 connect explosive switch 4 to the remainder of the system. In railgun applications, the switch is initially closed to provide high current charging of inductor 2 over an extended period of time. The pulsed dc source discharges into the inductor in hundreds of milliseconds to seconds. At peak current, the switch is exploded open, as shown in FIG. 1, to commute the current to the load within hundreds of microseconds. Such switches are capable of carrying, for example, 750 KiloAmperes to 1.5 MegAmperes and are capable of opening in hundreds of microseconds.

Figure 2:
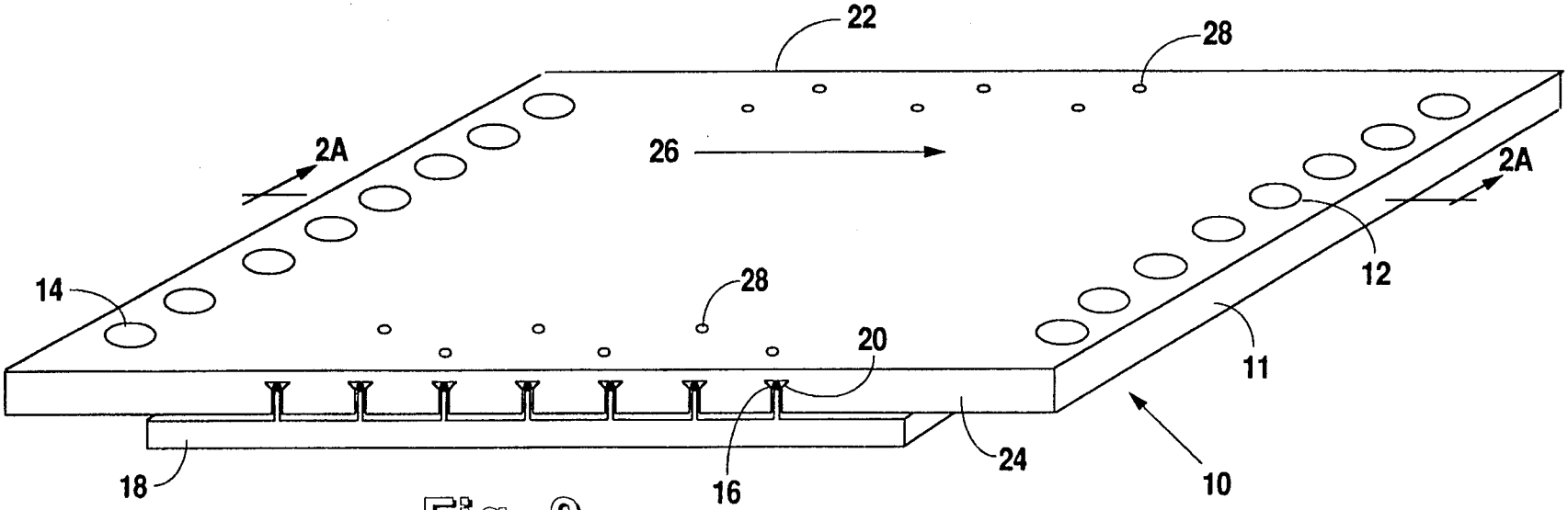
Fig. 2 ( PRIOR ART )
FIG. 2 is an oblique view of a prior art explosively actuated switch.
Figure 2A:
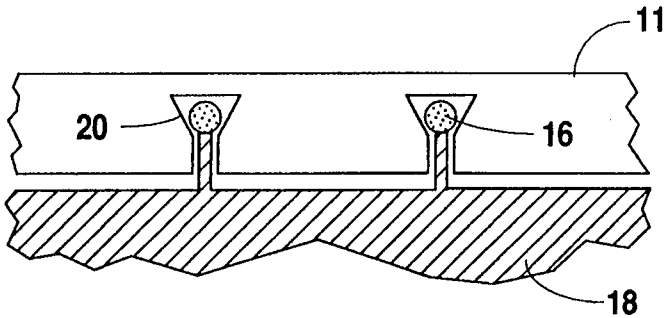
Fig. 2A ( PRIOR ART )
FIG. 2A—2A is a cross-sectional view along section line 2A of prior art FIG. 2.

An explosive switch of the prior art is shown in FIGS. 2 and 2A. Switch 10 comprises conductor 11, 6160-T6 aluminum for example, and a plurality of connecting bolt holes 12 and 14, or other connecting means. Connecting bolt holes 12 and 14 are used to electrically connect the circuit and the switch through the conductive leads 30 and 32 of FIG. 1 or other conductive means that engage the connecting bolt holes. When connected to the circuit, current 26 flows from bolt holes 14 to bolt holes 12.

Conductor 11 has a plurality of substantially parallel channels 20 as shown in FIGS. 2 and 2A. Channels 20 extend continuously from edge 24 to edge 22 of conductor 11 and are substantially perpendicular to edges 24 and 22. Explosive detonating cord 16, for example Ensign-Bickford PETN 50 grain per foot, "PRIMACORD" is placed from edge 22 to edge 24 in channels 20. The detonating cord is detonated with, for example, noise immune Exploding Bridgewire Detonators (not shown). Holder 18, a high density polyethylene, for example, holds detonating cord 16 close to conductor 11. A plastic backing (not shown) may be placed under holder 18 and fastened to switch 10 through one or more fastening holes 28 in conductor 11 and holder 18.

Figure 3:
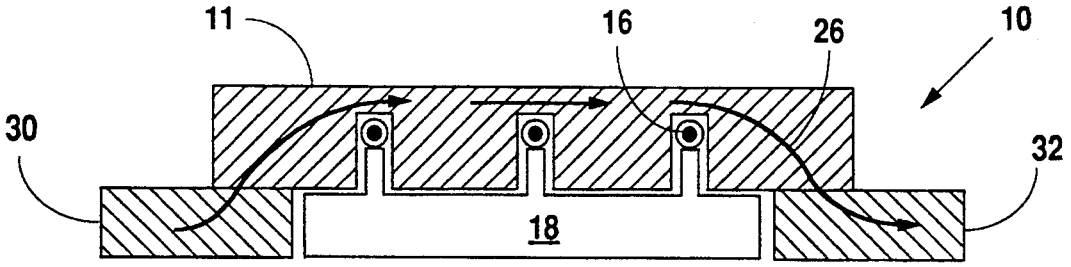
FIG. 3 is a cross-sectional view of a closed explosively actuated switch.

A cross-section of switch 10 in the closed state is shown in FIG. 3. The arrows represent the path of current 26 from conductive lead 30 through conductor 11 to conductive lead 32. Thus in the closed state, current 26 flows unobstructed over detonating cord 16.

Figure 4:
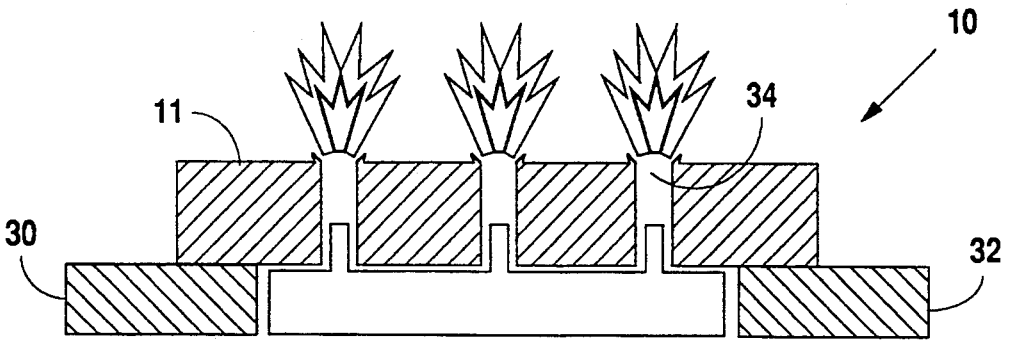
FIG. 4 is a cross-sectional view of an opened explosively actuated switch.

The opened state of switch 10 is shown in FIG. 4. When detonating cord 16 is detonated, a series of voids 34 are formed in conductor 11. Because detonating cord 16 is placed continuously from edge 24 to edge 22 of conductor 11, voids 34 are formed from edge 24 to edge 22. Thus, conductor 11 is completely severed by voids 34 such that a current path from conductive lead 30 to conductive lead 32 no longer exists. Experimental switch characteristics for prior art switch 10 are shown in FIG. 5. When detonating cord 16 is detonated, switch resistance 40 begins to rise and simultaneously switch current 42 falls and load current 44 rises. As can be graphically seen, current is substantially switched to the load over an interval of approximately 125 microseconds.

The present invention involves an improvement in prior art switch 10 that combines the effects of an explosive switch and a thermal switch in one fusible link so that switching characteristics may be more finely controlled. In one embodiment, the present invention involves removing a portion of detonating cord 16 such that conductor 11 is not completely severed by the explosively created void. Rather, only part of sheet 11 is severed by explosive forces and therefore, a conductive path between bolt holes 12 and 14 still exists. Thus, all the current is forced into a narrow bridge region that remains in conductor 11 where the detonating cord was removed and no void was created. The bridge region in conductor 11 then fails thermally due to the high current densities in the remaining current path.

By properly designing the shape, length, and cross-section of the bridge region, and the rate at which metal vapor is extracted from the conductor surfaces, the resistance characteristics of the vaporizing gap may be controlled. This in turn allows control of the opening switch characteristics. Magnetic pressure alone ejects the plasma from this region.

Figure 6:
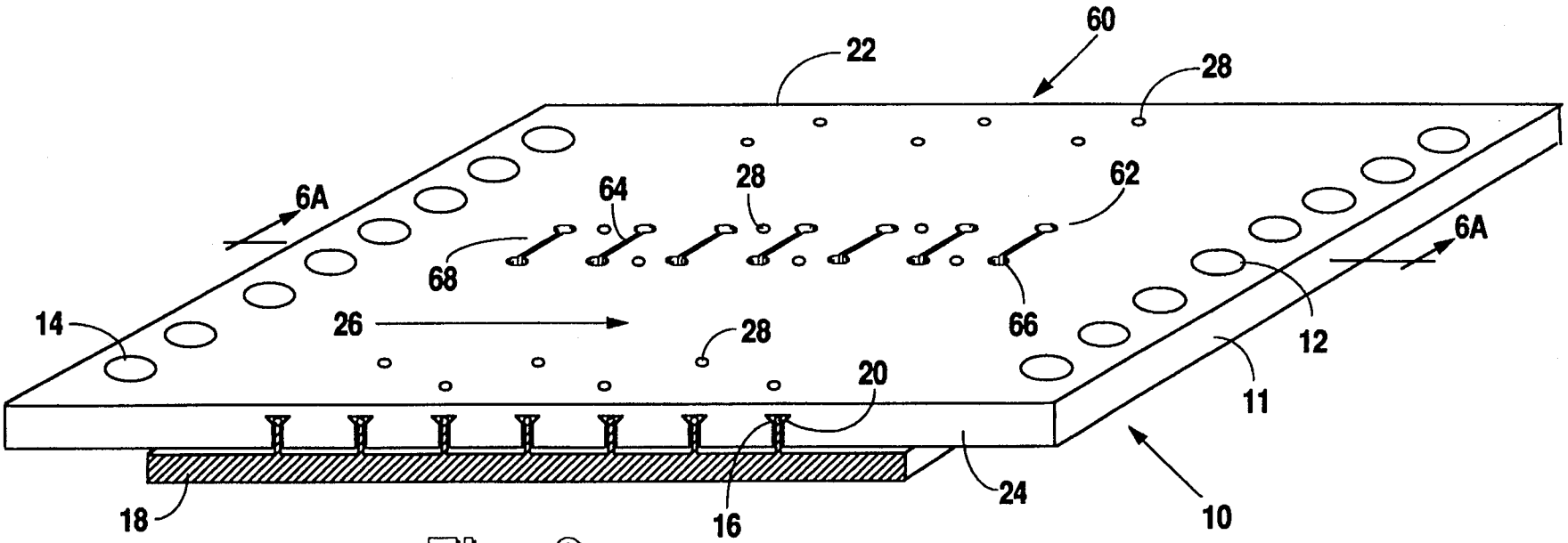
FIG. 6 is an oblique view of one embodiment of an explosively actuated switch according to the present invention.
Figure 6A:
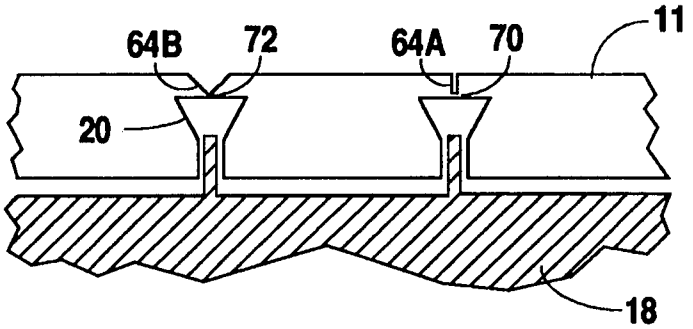
FIG. 6A is a cross-sectional view along section line 6A of FIG. 6.

An embodiment of the present invention is shown in FIGS. 6 and 6A. Switch 60 comprises a conductive conductor 11, 6160-T6 aluminum for example, and connecting bolt holes 12 and 14, or other connecting means. Channels 20 extend substantially from edge 24 to edge 22 of conductor 11. Two substantially parallel series of holes 66 and 62 are made over channels 20 in conductor 11. Holes 66 and 62 extend through conductor 11 to penetrate channels 20.

Grooves 64 are placed in the surface of conductor 11 between holes 62 and 66. Grooves 64 are substantially parallel to and above channels 20 and extend substantially from holes 66 to holes 62. Grooves 64 may take a variety of shapes as seen in FIG. 6A. Groove 64A is a square groove and groove 64B is a "V" groove. For ease of manufacturing, all such grooves in a switch are preferably the same shape. However, a user of the present invention may use different shaped grooves in the same switch. Grooves 64 may be made by machining methods such as milling, however other manufacturing methods may be used.

Grooves 64 and channels 20 are formed such that narrow link areas, such as link area 70 and link area 72, exist for current to flow from bolt holes 14 to bolt holes 12. The depth of grooves 64 may vary so that the cross-sectional area for the current flow in the link areas, and thus the current density, may be adjusted. For example, because groove 64B is deeper than groove 64A, the cross-sectional area of link area 72 is smaller than the cross-sectional area of link area 70. The current densities in link area 72 will, therefore, be higher than the current densities in link area 70.

Figure 7:
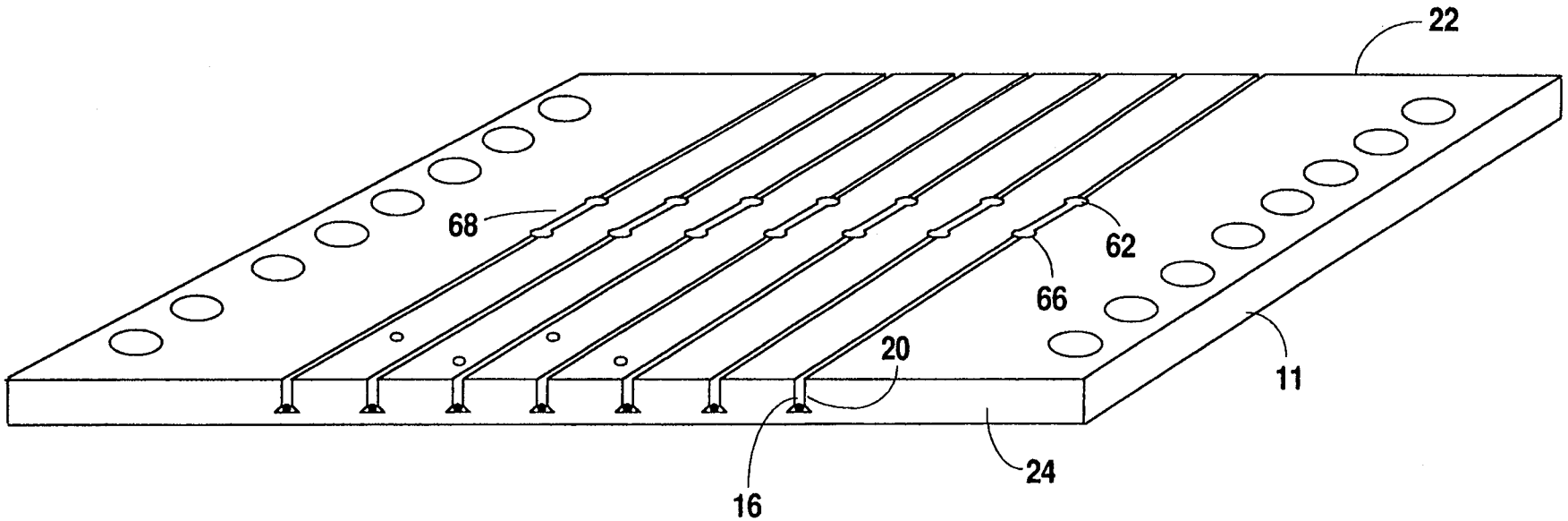
FIG. 7 is an oblique bottom view of the conductor of an explosively actuated switch according to the present invention.

Detonating cord 16, for example Ensign-Bickford PETN 50 grain per foot, "PRIMACORD", is placed in each channel 20. Detonating cord 16 extends from edge 24 to holes 66 and from edge 22 to holes 62. For each groove 64, no detonating cord is placed between holes 66 and holes 62 in bridge region 68. Thus as seen in FIG. 6A, a cross-section of bridge region 68 between holes 66 and 62, channels 20 are empty. A bottom view of conductor 11 is shown in FIG. 7. The shaded portions of channels 20 indicate the portions of channels 20 that will have detonating cord 16 proximate the surface. Bridge region 68 remains in the area where no detonating cord 16 is placed and thus where voids 34 are not created.

Holes 66 and 62 are preferably placed at the interior ends of detonating cord 16 so that when detonating cord 16 is detonated, holes 66 and 62 provide a path for the explosive forces to escape from the switch rather than to continue propagating through channel 20 into bridge region 68 under grooves 64. Holes 66 and 62 do not necessarily have to penetrate all the way from the top surface to the bottom surface of conductor 11. Preferably, though, holes 66 and 62 extend at least from the top surface to channels 20.

Switch 60 is operated by first detonating cords 16. The explosive forces create a series of parallel voids in conductor 11 substantially from edge 24 to holes 66 and from edge 22 to holes 62. Current 26 in switch 60 is then, therefore, directed into bridge region 68. Because the current must flow through narrow link areas such as link area 72 or link area 70, the current densities in link areas 72 and 70 are high enough to cause thermal break down or melting of conductor 11. By adding this thermal break down component to the switching mechanism of switch 60, the switch current characteristics may be slowed and controlled.

The switch characteristics of the present invention will thus be dependent upon, among other variables, the geometries of grooves 64. For example, the switching characteristics of a switch using the present invention are shown in FIG. 8. In this embodiment of switch 60, conductor 11 was made of 1.0 in. thick 6160 T-6 aluminum and holes 62 and 66 were 0.375 inches in diameter and 2 inches apart from center point to center point. Grooves 64 completely extend between the holes. Further, the grooves had a "V" shape 0.16 inches deep and 0.32 inches across at the surface and thus formed a link area height of 0.005 inches between grooves 64 and channels 20. As can be seen with reference to FIG. 8, current is substantially switched over an interval of approximately 300 micro seconds.

It is anticipated that grooves may also be square shaped forming link area heights ranging from 0.005 inches to 0.026 inches or semicircular shaped forming link area heights ranging from 0.005 inches to 0.026 inches. However, alternative embodiments of the present invention may use other geometries that are dependent on the user's switching requirements.

Those skilled in the art will recognize that many alternative embodiments of the present invention exist. Depending on the user's switching characteristics requirements, a number of variations in the invention may be made. For example, rather than being flat, conductor 11 may be designed in other shapes such as a tubular shape. Also, other conductive materials such as cooper and brass may be used and the user may vary the dimensions of the switch. In addition, the number of channels and the number of grooves in the switch may be varied and the number of channels and grooves do not even have to match. All the channels do not even have to have detonating cord. For example, even though a switch may have a number of channels, a user may place detonating cord in less than all of the channels.

Further depending on the current magnitude, switch geometry, and switch material, grooves may not even be required. As long as current densities that will cause thermal break down are forced into the portion of a conductor remaining after an explosive detonation, then the principle advantages of the present invention may be obtained. Thus, alternative explosive arrangements may be used with the present invention. In addition, multiple switches may be combined in series or parallel to vary a system's switching characteristics.

Further modifications and alternative embodiments of this invention will be apparent to those skilled in the art in view of this description. Accordingly, this description is to be construed as illustrative only and is for the purpose of teaching those skilled in the art the manner of carrying out the invention. It is understood that the forms of the invention herein shown and described are to be taken as the presently contemplated embodiments. For example, equivalent elements, materials or methods may be substituted for those illustrated and described herein, and certain features or methods of the invention may be utilized independently of the use of other features or methods, all as would be apparent to one skilled in the art after having the benefit of this description of the invention.

What is claimed is:

1. An electrical switch, comprising:

an electrical conductor; and an explosive proximate a portion of the conductor for selectively applying an explosive force to said portion of the conductor to sever said portion of the conductor so that a residual conductive path of reduced cross section through the conductor remains after the explosive force has been applied to the conductor.

2. The switch of claim 1, wherein the residual conductive path thermally breaks down when sufficient current in the conductor is directed into the residual conductive path after the explosive force has been applied to the conductor.

3. The switch of claim 2, further comprising at least one groove formed in the conductor in the residual conductive path.

4. The switch of claim 2, further comprising at least one channel formed in the conductor and configured to house the explosive.

5. The switch of claim 1, wherein the explosive is positioned in at least one channel in the conductor.

6. The switch of claim 5, further comprising at least one hole penetrating through the conductor to one of said channels.

7. An electrical switch comprising an electrical conductor and at least one channel within the conductor for housing an explosive, and explosive arranged to leave a residual conductive bridge region within the conductor upon detonation of the explosive, the current capacity of the bridge region being adapted so that the bridge region thermally opens after the explosive has been detonated.

8. An electrical switch, comprising:

an electrical conductor;

a plurality of substantially parallel channels formed in the conductor, adapted to house an explosive and arranged such that the explosive, when detonated, partially severs the conductor;

a bridge region within the conductor for conducting current after the explosive has been detonated, the bridge region comprising at least one thermal break down area; and a groove formed in the conductor proximate the at least one break down area.

9. An electrical switch operable in stages to interrupt an electrical circuit, comprising:

an electrical conductor having first and second conductive portions, the electrical conductor capable of passing an electrical current of a first predetermined current density; and an explosive proximate said conductor and operable upon detonation to sever a first conductive portion of said conductor and thereby force said electrical current through a second conductive portion of the conductor;

said second conductive portion operable to be severed in response to a second predetermined current density greater than said first predetermined current density.

10. An inductive energy storage system, comprising:

a primary energy source for supplying an electrical current, an inductor connected in series to said primary energy source for storing energy;

an explosive switch connected in series to said primary energy source and said inductor, said explosive switch comprising, an electrical conductor, and an explosive proximate the conductor for selectively applying an explosive force to a portion of the conductor so that a residual conductive path remains after the explosive force has been applied to the conductor; and a load connected in parallel across said explosive switch such that when said switch is opened said electric current is diverted into said load.

11. The inductive energy storage system of claim 10, wherein the residual conductive path thermally breaks down when sufficient current in the conductor is directed into the residual path after the explosive force has been applied to the conductor.

12. The inductive energy storage system of claim 11, wherein said primary energy source is a homopolar generator and said load is an electromagnetic railgun.

13. A method of interrupting an electrical current, comprising:

providing an electrical conductor formed as a unitary structure, said conductor having a first conductive portion and a second conductive portion;

directing said electrical current through said electrical conductor;

explosively severing said first conductive portion; and thermally breaking down said second conductive portion through resistive heating to interrupt said electrical current.

14. The method of claim 13, further comprising:

controlling switching characteristics by adjusting a shape and size of said second conductive portion.

15. The method of claim 14, further comprising:

forming channels within said electrical conductor for placing an explosive; and placing an explosive in said channels proximate said first conductive portion.

16. The method of claim 14, wherein said controlling step comprises placing grooves in the second conductive portion.

17. The method of claim 13, further comprising:

placing an explosive proximate said first conductive portion; and directing an explosive force from said explosive away from said second conductive portion through a hole in said electrical conductor.

* * * * *